US011480893B2

(12) United States Patent
Takeuchi et al.

(10) Patent No.: US 11,480,893 B2
(45) Date of Patent: Oct. 25, 2022

(54) IMAGE FORMING APPARATUS CAPABLE OF RETURNING SCATTERED TONER AT A PORTION WHERE A DEVELOPING ROLLER AND A SUPPLY ROLLER FACE EACH OTHER TO A CIRCULATION PATH DURING AN IMAGE FORMING OPERATION

(71) Applicant: CANON KABUSHIKI KAISHA, Tokyo (JP)

(72) Inventors: Kosuke Takeuchi, Chiba (JP); Atsushi Matsumoto, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/581,775

(22) Filed: Jan. 21, 2022

(65) Prior Publication Data

US 2022/0253004 A1 Aug. 11, 2022

(30) Foreign Application Priority Data

Feb. 5, 2021 (JP) ..... JP2021-017379

(51) Int. Cl.
*G03G 15/09* (2006.01)

(52) U.S. Cl.
CPC ..... *G03G 15/0907* (2013.01)

(58) Field of Classification Search
CPC ..... G03G 15/0907; G03G 15/0815
USPC ..... 399/270, 273
See application file for complete search history.

(56) References Cited

U.S. PATENT DOCUMENTS

| | | | | |
|---|---|---|---|---|
| 8,699,925 | B2 * | 4/2014 | Kashimoto et al. | G03G 15/0812 399/273 |
| 8,934,818 | B2 * | 1/2015 | Eiki | G03G 15/0808 399/273 |
| 9,158,229 | B2 * | 10/2015 | Ohashi et al. | G03G 15/0815 |
| 9,665,037 | B2 * | 5/2017 | Otani et al. | G03G 15/0812 |
| 10,042,283 | B2 * | 8/2018 | Kamiyama | G03G 15/0812 |
| 2012/0201575 | A1 | 8/2012 | Kashimoto | |

FOREIGN PATENT DOCUMENTS

| | | |
|---|---|---|
| JP | 2009063809 A | 3/2009 |
| JP | 2009109947 A | 5/2009 |
| JP | 2011022307 A | 2/2011 |

* cited by examiner

*Primary Examiner* — William J Royer
(74) *Attorney, Agent, or Firm* — Canon U.S.A., Inc. I.P. Division

(57) ABSTRACT

An image forming apparatus includes an image carrier, an exposure device to expose the image carrier to form an electrostatic latent image on the image carrier, a conductive member, and a developing device having a rotatable developing roller and a rotatable toner supply roller. Polarity of direct-current components of biases applied during an image forming operation to the conductive member, the developing roller, and the toner supply roller are the same as a polarity of normally charged toner. An absolute value of the bias applied to the developing roller during the image forming operation is smaller than an absolute value of the bias applied to the toner supply roller during the image forming operation. The absolute value of the bias applied to the toner supply roller during the image forming operation is smaller than an absolute value of the bias applied to the conductive member during the image forming operation.

10 Claims, 9 Drawing Sheets

COMPARATIVE EXAMPLE

IMAGE FORMING APPARATUS CAPABLE OF RETURNING SCATTERED TONER AT A PORTION WHERE A DEVELOPING ROLLER AND A SUPPLY ROLLER FACE EACH OTHER TO A CIRCULATION PATH DURING AN IMAGE FORMING OPERATION

BACKGROUND

Field

The present disclosure relates to an image forming apparatus that includes a developing device having a toner supply roller supplying only toner to a developing roller.

Description of the Related Art

A developing device discussed in United States Patent Application Publication No. 20120201575 includes a developer container that houses a developer containing toner and carriers, a developing roller that carries and conveys the toner to a developing position, and a toner supply roller that carries and conveys the developer supplied from a circulation path of the developer and supplies only the toner to the developing roller. In the developing device, a toner receiving member that receives the toner scattered at a portion where the toner supply roller and the developing roller face each other, and other portions, is provided near the developing roller, and a vibration member vibrating the toner receiving member is provided on a rear surface of the toner receiving member. Further, in a configuration discussed in United States Patent Application Publication No. 20120201575, the toner receiving member is vibrated by the vibration member when an image is not formed, which causes the toner accumulating on the toner receiving member to slide down and return to the circulation path.

In the configuration discussed in United States Patent Application Publication No. 2012/0201575, however, when the toner receiving member is vibrated by the vibration member in order to return the toner accumulating on the toner receiving member to the circulation path, it is necessary to stop image forming operation. In addition, if vibration frequency of the toner receiving member is increased in order to prevent the toner from excessively accumulating on the toner receiving member, stop frequency of the image forming operation is increased, which deteriorates productivity. Therefore, in the developing device including the toner supply roller supplying only the toner to the developing roller, it is desired to provide a new configuration that can prevent deterioration of productivity by returning the toner scattered at the portion where the toner supply roller and the developing roller face each other, and other portions, to the circulation path during the image forming operation.

SUMMARY

The present disclosure is directed to an image forming apparatus that includes a developing device having a toner supply roller supplying only toner to a developing roller and can return toner scattered at a portion where the toner supply roller and the developing roller face each other to a circulation path during an image forming operation.

According to an aspect of the present disclosure, an image forming apparatus includes an image carrier, an exposure device configured to expose the image carrier to form an electrostatic latent image on the image carrier, a developing device including (i) a first chamber configured to accommodate a developer containing toner and carriers, (ii) a second chamber separated from the first chamber by a partition wall and configured to form a circulation path with the first chamber for the developer, (iii) a first conveyance screw disposed in the first chamber and configured to convey the developer in a first direction, (iv) a second conveyance screw disposed in the second chamber and configured to convey the developer in a second direction opposite to the first direction, (v) a developing roller that is rotatable, disposed to face the image carrier, and configured to carry and convey the toner to a developing position where the electrostatic latent image formed on the image carrier is developed, (vi) a toner supply roller that is rotatable, disposed to face the developing roller, and configured to carry and convey the developer supplied from the first chamber and to supply only the toner to the developing roller, and (vii) a regulation member disposed to face the toner supply roller and configured to regulate an amount of developer carried by the toner supply roller, and a conductive member disposed to face the toner supply roller on a downstream of a position on the toner supply roller where the regulation member comes closest to the toner supply roller and on an upstream of a position on the toner supply roller where the developing roller comes closest to the toner supply roller, in the rotation direction of the toner supply roller, wherein a rotation direction of the toner supply roller is opposite to a rotation direction of the developing roller at a position where the toner supply roller and the developing roller face each other, wherein the toner supply roller internally includes a first magnet, where the first magnet is fixed and disposed not to be rotatable and includes a plurality of magnetic poles including a first magnetic pole, wherein the developing roller internally includes a second magnet, where the second magnet is fixed and disposed not to be rotatable, and includes only a second magnetic pole that is disposed to face the first magnetic pole and is different in polarity from the first magnetic pole, wherein a polarity of a direct-current component of a bias applied to the conductive member during an image forming operation, a polarity of the direct-current component of a bias applied to the toner supply roller during the image forming operation, and a polarity of the direct-current component of a bias applied to the developing roller during the image forming operation are the same as a polarity of normally charged toner, wherein an absolute value of the bias applied to the developing roller during the image forming operation is smaller than an absolute value of the bias applied to the toner supply roller during the image forming operation, and wherein the absolute value of the bias applied to the toner supply roller during the image forming operation is smaller than an absolute value of the bias applied to the conductive member during the image forming operation.

Further features of the present disclosure will become apparent from the following description of exemplary embodiments with reference to the attached drawings.

DESCRIPTION OF THE EMBODIMENTS

Some exemplary embodiments of the present disclosure will be described in detail below with reference to the accompanying drawings. The exemplary embodiments described below do not limit the present disclosure according to claims, and all of the combinations of features described in a first exemplary embodiment are not necessarily essential for the present disclosure. The present disclosure can be implemented in various applications such as a printer, various kinds of printing machines, a copier, a facsimile (FAX), and a multifunctional peripheral.

(Configuration of Image Forming Apparatus)

Figure 1:
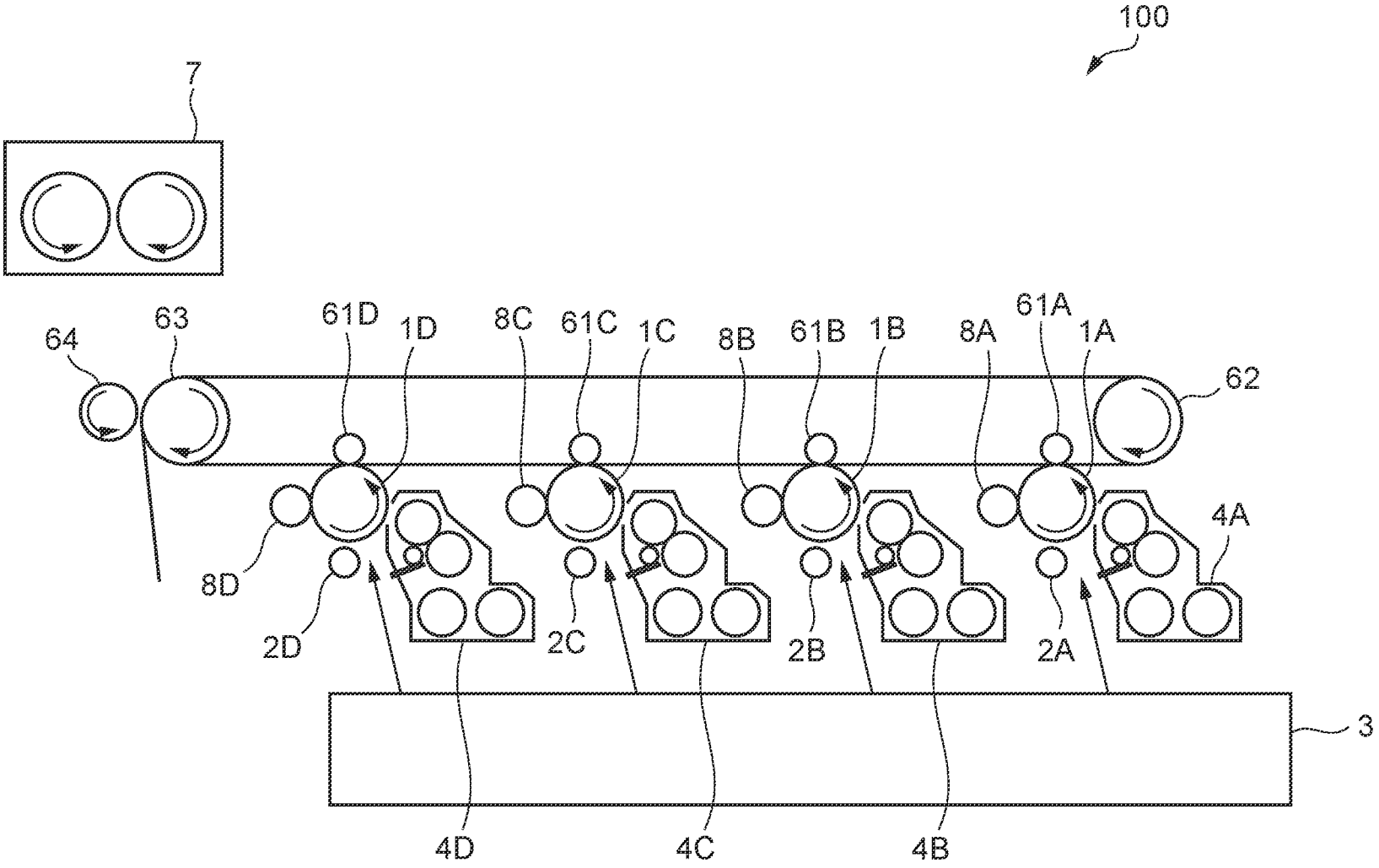
FIG. 1 is a diagram illustrating an entire configuration of an image forming apparatus according to a first exemplary embodiment.

First, an entire configuration of an image forming apparatus according to a first exemplary embodiment of the present disclosure will be described with reference to FIG. 1. As illustrated in FIG. 1, an image forming apparatus 100 according to the first exemplary embodiment adopts a tandem system. Drum cartridges forming toner images of four colors of yellow, magenta, cyan, and black are provided together. In the following description, components common to the drum cartridges of the four colors in FIG. 1 are denoted by numerals without alphabets.

Image formation by the image forming apparatus 100 is performed in the following manner. A surface of a photosensitive drum 1 (image carrier) is uniformly charged by a charging device 2. An exposure device 3 exposes the surface of the photosensitive drum 1 charged by the charging device 2 to form an electrostatic latent image on the photosensitive drum 1. Thereafter, toner is caused to adhere to the electrostatic latent image formed on the photosensitive drum 1 from a developing device 4, at a developing position where the electrostatic latent image is developed. As a result, the electrostatic latent image formed on the photosensitive drum 1 is developed as a toner image. The toner image is transferred onto an intermediate transfer belt 62 by a primary transfer roller 61. After toner images of a plurality of colors are transferred in an overlapping manner onto the intermediate transfer belt 62, the toner images of the four colors are transferred to a recording medium (sheet) that is conveyed from a sheet feeding cassette to a secondary transfer portion where a secondary transfer roller 63 and a secondary outer transfer roller 64 abut on each other. A fusing device 7 heats and pressurizes the recording medium to fix the toner images. Thereafter, the recording medium is discharged to outside of the image forming apparatus 100. Residual toner remaining on the photosensitive drum 1 after transfer is removed by a cleaning device 8.

(Configuration of Developing Device)

A configuration of the developing device 4 according to the first exemplary embodiment will be described with reference to a cross-sectional view (schematic side cross-sectional view) in FIG. 2. Note that FIG. 2 illustrates a state as viewed from a rear surface side in FIG. 1, and arrangement of components inside the developing device 4 is reversed right and left from arrangement in FIG. 1.

Figure 2:
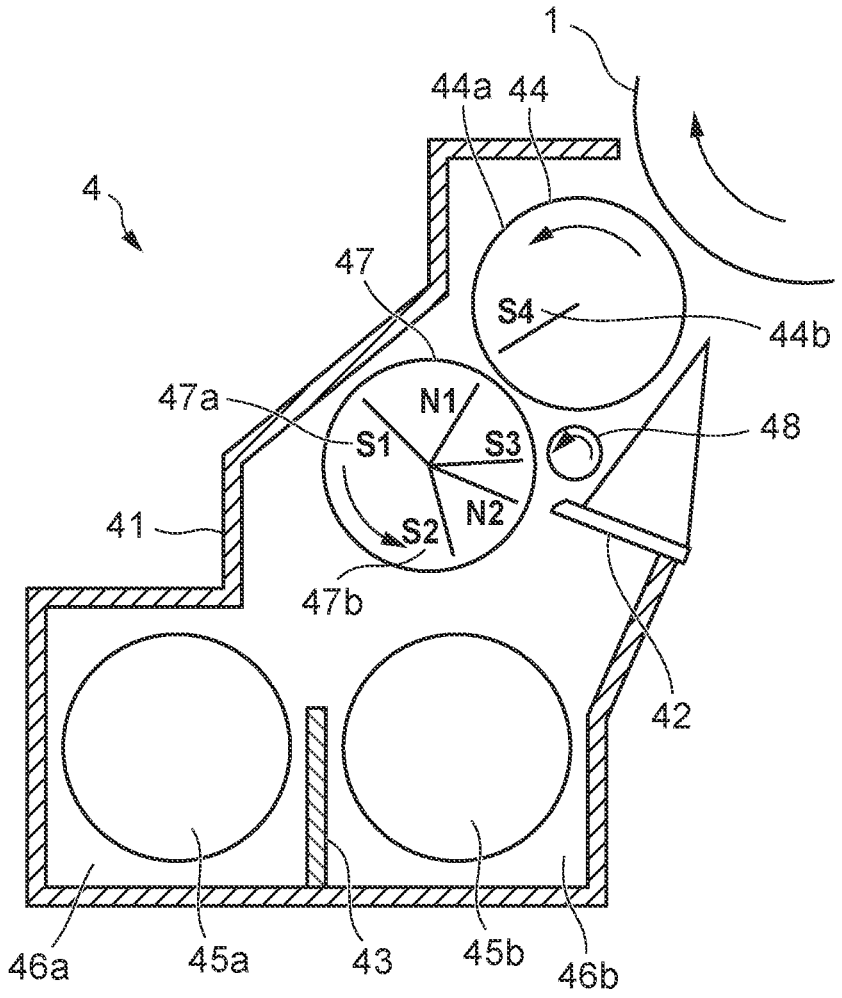
FIG. 2 is a cross-sectional view illustrating a configuration of a developing device according to the first exemplary embodiment.

As illustrated in FIG. 2, the developing device 4 includes a developer container 41 housing two-component developer (hereinafter, simply referred to as developer) containing toner and carriers. The developer container 41 is divided by a partition wall 43 into a stirring conveyance chamber 46*a* and a supply conveyance chamber 46*b*. The stirring conveyance chamber 46*a* and the supply conveyance chamber 46*b* respectively include a rotatable stirring conveyance screw 45*a* and a rotatable supply conveyance screw 45*b*. The stirring conveyance screw 45*a* and the supply conveyance screw 45*b* mix and stir toner (positively charged toner) supplied from a replenishment toner container, with carriers, and charges the resultant developer. The developer is conveyed in an axial direction (direction perpendicular to paper surface in FIG. 2) while being stirred by the stirring conveyance screw 45*a* and the supply conveyance screw 45*b*. The developer circulates between the stirring conveyance chamber 46*a* and the supply conveyance chamber 46*b* through developer paths provided at both ends of the partition wall 43. In other words, the circulation path of the developer is formed by the stirring conveyance chamber 46*a*, the supply conveyance chamber 46*b*, and the developer paths, in the developer container 41.

The developer container 41 extends diagonally right upward in FIG. 2. In the developer container 41, a toner supply roller 47 is disposed above the supply conveyance screw 45*b*. Further, in the developer container 41, a developing roller 44 is disposed to face the toner supply roller 47. The developing roller 44 is disposed to face the photosensitive drum 1 on an opening side of the developer container 41, and a rotation center of the developing roller 44 is disposed above a rotation center of the toner supply roller 47.

The toner supply roller 47 and the developing roller 44 each rotate in a counterclockwise direction in the drawing around a corresponding rotation axis. In other words, the toner supply roller 47 and the developing roller 44 rotate in directions counter to each other at a facing position (opposing position).

The toner supply roller 47 includes a non-magnetic toner supply sleeve 47*a* rotating in the counterclockwise direction in FIG. 2, and a supply magnet 47*b* that is fixed and disposed inside the toner supply sleeve 47*a* so as not to be rotatable and includes a plurality of magnetic poles. The toner supply roller 47 functions as a magnetic roller.

The toner supply roller 47 supplies only the toner to the developing roller 44 by an electric field formed between the toner supply roller 47 and the developing roller 44 at a portion where the toner supply roller 47 and the developing roller 44 face each other. At the portion where the toner supply roller 47 and the developing roller 44 face each other, a small amount of carriers in the developer carried by the toner supply roller 47 may adhere to the developing roller 44. Even in this case, it is regarded that the toner supply roller 47 supplies only the toner in the developer carried by the toner supply roller 47, to the developing roller 44.

The supply magnet 47*b* includes five magnetic poles N1, S1, S2, N2, and S3. In the first exemplary embodiment, the five magnetic poles N1, S1, S2, N2, and S3 respectively have magnetic flux densities (peak values of magnetic flux density Br in normal direction of toner supply roller 47) of 100 mT, 50 mT, 50 mT, 60 mT, and 60 mT.

The developing roller 44 includes a cylindrical developing sleeve 44*a* rotating in the counterclockwise direction in FIG. 2, and a developing magnet 44*b* fixed and disposed inside the developing sleeve 44*a* so as not to be rotatable.

The developing magnet 44*b* includes one magnetic pole S4. The toner supply roller 47 and the developing roller 44 face each other with a predetermined gap (hereinafter, shortest distance between toner supply roller 47 and developing roller 44 is referred to as SS gap) at the facing position (opposing position). In the first exemplary embodiment, the SS gap is set to 250 μm. The magnetic pole S4 of the developing magnet 44*b* is different in polarity from the facing magnetic pole (N1) of the supply magnet 47*b*. In the first exemplary embodiment, the magnetic pole S4 has a magnetic flux density (peak value of magnetic flux density Br in normal direction of developing roller 44) of 50 mT.

The developer container 41 further includes a developing blade 42 (regulation member) that is attached along a longitudinal direction (direction perpendicular to paper surface in FIG. 2) of the toner supply roller 47. The developing blade 42 is disposed to face the toner supply roller 47. The developing blade 42 is a regulation member regulating an amount of developer carried by the toner supply roller 47. The developing blade 42 is disposed on an upstream side of a position where the developing roller 44 and the toner supply roller 47 face each other in the rotation direction (counterclockwise direction in drawing) of the toner supply roller 47. Further, a slight gap (hereinafter, shortest distance between developing blade 42 and toner supply roller 47 is referred to as SB gap) is provided between a front end of the developing blade 42 and a surface of the toner supply roller 47. The developer on the toner supply roller 47 passes through the SB gap with rotation of the toner supply roller 47. As a result, an amount of developer carried by the toner supply roller 47 is regulated. In the first exemplary embodiment, the SB gap is set to 500 μm.

A direct-current voltage (hereinafter, referred to as Vslv (DC)) and an alternating-current voltage (hereinafter, referred to as Vslv(AC)) are applied to the developing roller 44 by a bias application unit. Further, a direct-current voltage (hereinafter, referred to as Vmag(DC)) and an alternating-current voltage (hereinafter, referred to as Vmag (AC)) are applied to the toner supply roller 47. The direct-current voltages and the alternating-current voltages are applied to the developing roller 44 and the toner supply roller 47 from a developing bias electric power source (bias application unit) via a bias control circuit. A potential difference between Vmag(DC) applied to the toner supply roller 47 and Vslv(DC) applied to the developing roller 44 is denoted by ΔV. A thickness of a toner layer on the developing roller 44 is varied depending on a resistance of the developer, a rotation speed difference between the toner supply roller 47 and the developing roller 44, and the like, but is controllable by the potential difference ΔV. When the potential difference ΔV is increased, the thickness of the toner layer on the developing roller 44 is increased. In contrast, when the potential difference ΔV is reduced, the thickness of the toner layer on the developing roller 44 is reduced. A suitable range of the potential difference ΔV in development is generally approximately 100 V to 350 V. In the first exemplary embodiment, the potential difference ΔV is set to 150 V.

(Operation of Developing Device)

Subsequently, operation of the developing device 4 is described with reference to FIG. 2. As described above, the toner in the developer is charged by circulating the developer in the stirring conveyance chamber 46*a* and the supply conveyance chamber 46*b* of the developer container 41 while the developer is stirred by the stirring conveyance screw 45*a* and the supply conveyance screw 45*b*. The developer in the supply conveyance chamber 46*b* is supplied to the toner supply roller 47 by the supply conveyance screw 45*b* and magnetic force of the magnetic pole S2 of the supply magnet 47*b*. Further, a magnetic brush is formed on the toner supply roller 47 by magnetic force of the magnetic poles N1, S1, S2, N2, and S3 of the supply magnet 47*b*.

The magnetic brush formed on the toner supply roller 47 is regulated in thickness by the developing blade 42 and the magnetic pole N2 of the supply magnet 47*b*. Thereafter, the developer on the toner supply roller 47 is conveyed to the portion where the toner supply roller 47 and the developing roller 44 face each other, by rotation of the toner supply roller 47 and the magnetic pole S3 of the supply magnet 47*b*.

A toner thin layer is formed on the developing roller 44 by the potential difference ΔV between Vmag(DC) applied to the toner supply roller 47 and Vslv(DC) applied to the developing roller 44, and a magnetic field formed by the magnetic pole N1 of the supply magnet 47*b* and the magnetic pole S4 of the developing magnet 44*b*. The toner thin layer formed on the developing roller 44 is conveyed to a portion (opposing area) where the photosensitive drum 1 and the developing roller 44 face each other, by rotation of the developing roller 44. Since Vslv(DC) and Vslv(AC) are applied to the developing roller 44, the toner flies from the developing roller 44 to the photosensitive drum 1 due to a potential difference between the developing roller 44 and the photosensitive drum 1, and the electrostatic latent image on the photosensitive drum 1 is developed.

On the other hand, the residual toner not used for development is again conveyed to the portion where the developing roller 44 and the toner supply roller 47 face each other, by rotation of the developing roller 44, and is collected by the magnetic brush on the toner supply roller 47. The toner collected by the magnetic brush on the toner supply roller 47 is peeled from the toner supply roller 47 by a repulsive magnetic field, between the magnetic poles S1 and S2 of the supply magnet 47*b*, and then falls into the supply conveyance chamber 46*b*.

Thereafter, a predetermined amount of toner is replenished to the developing device 4 from a toner replenishing port based on a detection result of a toner density sensor, and the developer becomes the two-component developer uniformly charged at appropriate toner density again while circulating through the supply conveyance chamber 46*b* and the stirring conveyance chamber 46*a*. The developer is again supplied onto the toner supply roller 47 by the supply conveyance screw 45*b* and the magnetic pole S2 of the supply magnet 47*b*, forms a magnetic brush on the toner supply roller 47, and is conveyed to the developing blade 42 with rotation of the toner supply roller 47.

(Configuration of Toner Collection Roller)

During the image forming operation, namely, when the developing device 4 is driven, the toner is scattered from the toner supply roller 47, the developing roller 44, and the portion where the toner supply roller 47 and the developing roller 44 face each other, by rotation of the toner supply roller 47 and rotation of the developing roller 44. Therefore, in the first exemplary embodiment, a toner collection roller 48 collecting the scattered toner is provided near the developing roller 44 and the toner supply roller 47 inside the developer container 41. Further, in the developing device 4 including the toner supply roller 47 that supplies only the toner to the developing roller 44, a bias is applied to each of the toner supply roller 47, the developing roller 44, and the toner collection roller 48 during the image forming operation. As a result, in the first exemplary embodiment, during the image forming operation, the scattered toner is returned to the circulation path of the developer from a portion where the toner supply roller 47 and the toner collection roller 48 face each other. The detail thereof will be described below.

As illustrated in FIG. 2, the toner collection roller 48 (conductive roller) made of a non-magnetic metal is disposed along a longitudinal direction (direction perpendicular to paper surface in FIG. 1) of the developer container 41, near the developing roller 44 and the toner supply roller 47 on a right-side wall of the developer container 41. Further, the toner collection roller 48 is disposed on a downstream of a position on the toner supply roller 47 where the developing blade 42 comes closest to the toner supply roller 47, in the rotation direction of the toner supply roller 47. In addition, the toner collection roller 48 is disposed on an upstream of a position on the toner supply roller 47 where the developing roller 44 comes closest to the toner supply roller 47, in the rotation direction of the toner supply roller 47.

The toner collection roller 48 is disposed to face the toner supply roller 47 and the developing roller 44, and to have a constant gap with the developing roller 44.

As illustrated in FIG. 2, the toner collection roller 48 rotates in the counterclockwise direction. During the image forming operation, an alternating-current bias Vcol(AC) and a direct-current bias Vcol(DC) are applied to the toner collection roller 48 by the bias application unit, and the toner collection roller 48 is set to a plus side relative to the developing roller 44 and the toner supply roller 47. Therefore, during the image forming operation, positively charged toner moves from the toner collection roller 48 to the developing roller 44 and the toner supply roller 47. In the first exemplary embodiment, a potential difference between the toner collection roller 48 and the toner supply roller 47 is set to +100 V. A potential difference between Vcol(DC) applied to the toner collection roller 48 and Vmag(DC) applied to the toner supply roller 47 is denoted by ΔVcol.

As described above, in the first exemplary embodiment, the potential difference ΔV between Vmag(DC) applied to the toner supply roller 47 and Vslv(DC) applied to the developing roller 44 is set to 150 V. Therefore, in the first exemplary embodiment, a potential difference between the toner collection roller 48 and the developing roller 44 becomes +250 V.

Figure 3:
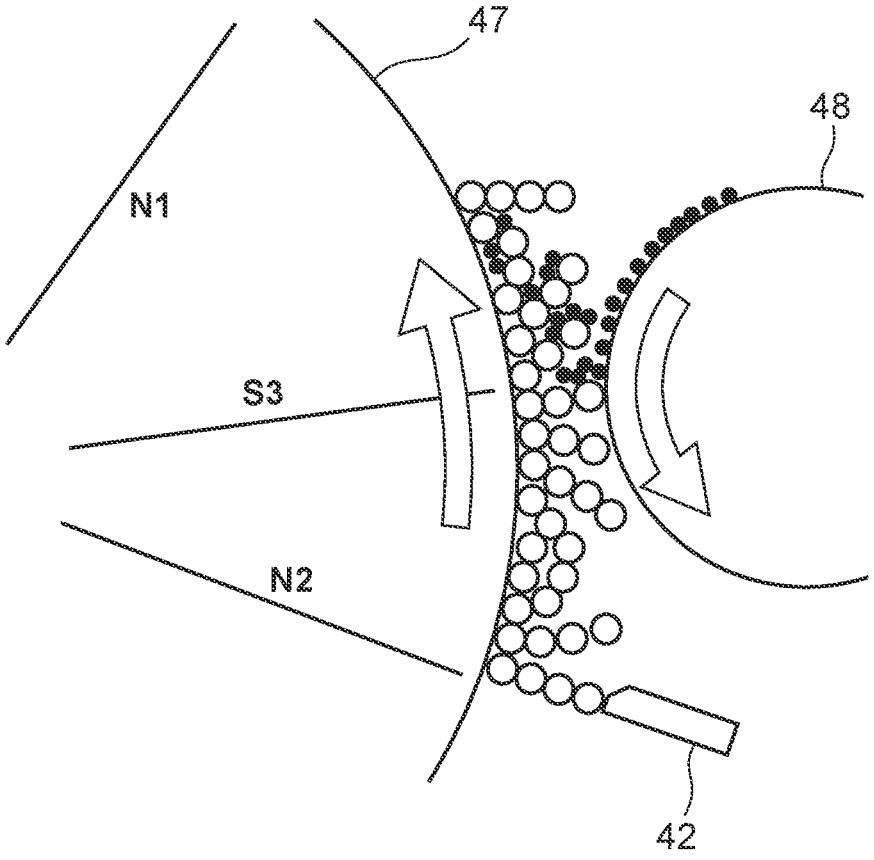
FIG. 3 is a schematic diagram illustrating a state where scattered toner is collected between a toner supply roller and a toner collection roller according to the first exemplary embodiment.

FIG. 3 is a schematic diagram illustrating a state where scattered toner is collected between the toner supply roller 47 and the toner collection roller 48 according to the first exemplary embodiment.

The normally charged toner (positively charged toner in first exemplary embodiment) of the scattered toner receives force of the electric field toward the toner supply roller 47, by the potential difference ΔVcol between the toner collection roller 48 and the toner supply roller 47, and is returned to the toner supply roller 47. The toner returned from the toner collection roller 48 to the toner supply roller 47 is thereafter peeled from the toner supply roller 47 by a repulsive magnetic field, between the magnetic poles S1 and S2 of the supply magnet 47*b*, and then falls into the supply conveyance chamber 46*b*. In the developing device 4 including the toner supply roller 47 that supplies only the toner to the developing roller 44, a bias is applied to each of the toner supply roller 47, the developing roller 44, and the toner collection roller 48 during the image forming operation. As a result, in the first exemplary embodiment, during the image forming operation, it is possible to return the scattered toner to the circulation path of the developer from the portion where the toner supply roller 47 and the toner collection roller 48 face each other.

In contrast, substantially uncharged toner and reversely charged toner (negatively charged toner in first exemplary embodiment) adhere onto the toner collection roller 48 in a state where the potential difference ΔVcol between the toner collection roller 48 and the toner supply roller 47 is formed.

The toner adhering onto the toner collection roller 48 is conveyed to the portion where the toner collection roller 48 and the toner supply roller 47 face each other, with rotation of the toner collection roller 48. At the portion where the toner collection roller 48 and the toner supply roller 47 face each other, the toner adhering onto the toner collection roller 48 is collected by the magnetic brush formed on the toner supply roller 47, as illustrated in FIG. 3.

In the first exemplary embodiment, the toner collection roller 48 is disposed to face the toner supply roller 47 at a position where the magnetic flux density of the magnetic pole S3 of the supply magnet 47*b* (magnetic flux density Br of magnetic pole S3 in normal direction of toner supply roller 47) has a peak. On the other hand, it is sufficient to dispose the toner collection roller 48 at a position where the magnetic brush on the toner supply roller 47 comes into contact with the toner collection roller 48. Therefore, the toner collection roller 48 is not necessarily located at the position facing the position where the magnetic flux density of the magnetic pole S3 of the supply magnet 47*b* has a peak.

In the first exemplary embodiment, the gap (shortest distance) between the developing roller 44 and the toner collection roller 48 is set to 4000 μm. In addition, in the first exemplary embodiment, a gap between the toner supply roller 47 and the toner collection roller 48 (hereinafter, shortest distance between toner supply roller 47 and toner collection roller 48 is referred to as SR gap) is set to 350 μm.

As described above, the shortest distance between the toner supply roller 47 and the toner collection roller 48 is made shorter than the shortest distance between the developing roller 44 and the toner collection roller 48. As a result, when the bias is applied to each of the toner supply roller 47, the developing roller 44, and the toner collection roller 48 during the image forming operation, it is possible to draw the scattered toner from the toner collection roller 48 to the toner supply roller 47 by the electric field.

Relationship of the distance (SR gap) between the toner supply roller 47 and the toner collection roller 48 with a toner collection rate according to the first exemplary embodiment will be described with reference to FIG. 4. A lateral axis in FIG. 4 indicates the gap (SR gap) between the toner supply roller 47 and the toner collection roller 48. A vertical axis in FIG. 4 indicates a collection rate (toner collection rate) of the toner adhering onto the toner collection roller 48 by the magnetic brush formed on the toner supply roller 47. The toner collection rate is calculated from the amount of toner adhering onto the toner collection roller 48 before and after passing the gap (SR gap) between the toner supply roller 47 and the toner collection roller 48. More specifically, the amount of toner on the toner collection roller 48 is measured before and after passing the gap (SR gap) between the toner supply roller 47 and the toner collection roller 48. In a case where the amount of toner adhering onto the toner collection roller 48 after passing the SR gap is zero, the toner collection rate is 100%. On the other hand, the amount of toner on the toner collection roller 48 is measured before and after passing the gap (SR gap) between the toner supply roller 47 and the toner collection roller 48. In a case where the amount of toner adhering onto the toner collection roller 48 is not changed before and after passing the SR gap, the toner collection rate is 0%.

Figure 4:
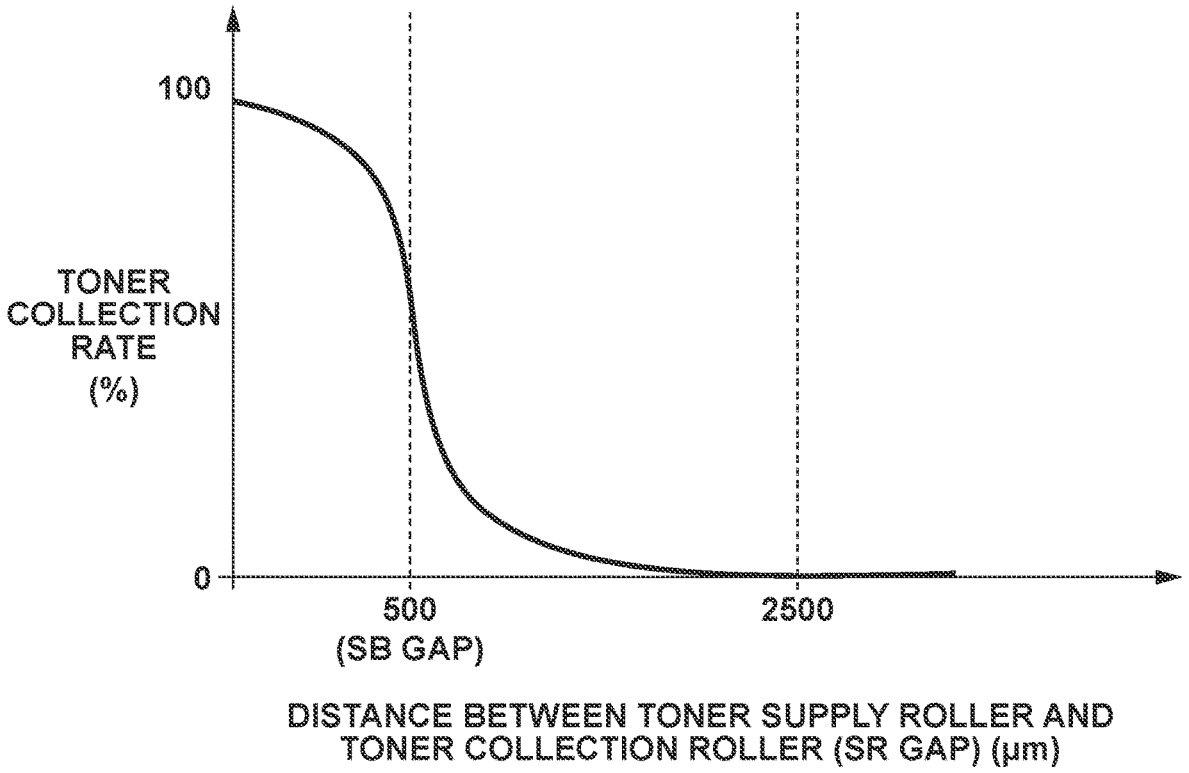
FIG. 4 is a diagram illustrating a relationship of a distance between the toner supply roller and the toner collection roller with a toner collection rate according to the first exemplary embodiment.

As illustrated in FIG. 4, the gap (SR gap) between the toner supply roller 47 and the toner collection roller 48 is greater than the gap (SB gap) between the toner supply roller 47 and the developing blade 42 (SB gap is 500 μm in first exemplary embodiment). In this case, the magnetic brush on the toner supply roller 47 does not come into contact with the toner collection roller 48. This is because, in the first exemplary embodiment, a height of the magnetic brush on the toner supply roller 47 is less than 500 μm. Accordingly, in a case where the SR gap is greater than 500 μm, an effect of collecting the toner adhering onto the toner collection roller 48, by the magnetic brush formed on the toner supply roller 47 is small at the portion where the toner collection roller 48 and the toner supply roller 47 face each other.

Further, as illustrated in Table 1, it is assumed that the gap (SR gap) between the toner supply roller 47 and the toner collection roller 48 is excessively smaller than the gap (SS gap) between the toner supply roller 47 and the developing roller 44 at the opposing position. In this case, the toner collection roller 48 scrapes off the magnetic brush on the toner supply roller 47, which causes clogging with the developer at the SR gap.

Therefore, to prevent clogging with the developer at the SR gap, it is necessary to make the SR gap greater than the gap (SS gap) between the toner supply roller 47 and the developing roller 44 at the opposing position. In the first exemplary embodiment, the SS gap is set to 250 μm, whereas the SR gap is set to 350 μm. As illustrated in Table 1, setting the SR gap to 300 μm or more makes it possible to prevent clogging with the developer at the SR gap.

In other words, in a case where the toner collection roller 48 is non-magnetic, it is desirable to set the shortest distance between the toner supply roller 47 and the toner collection roller 48 to 300 μm or more and 500 μm or less.

TABLE 1

| SR gap | Prevention of Clogging with Developer |
|---|---|
| 100 | Poor |
| 150 | Poor |
| 200 | Poor |
| *250 | Poor |
| 300 | Good |
| 350 | Good |
| 400 | Good |
| 450 | Good |
| 500 | Good |

*SS Gap

In summary, to enhance the effect of collecting the toner adhering onto the toner collection roller 48, by the magnetic brush formed on the toner supply roller 47, it is desirable to satisfy an inequality of SB gap>SR gap. In other words, it is desirable to make the shortest distance between the toner supply roller 47 and the toner collection roller 48 shorter than the shortest distance between the toner supply roller 47 and the developing blade 42.

Further, to prevent clogging with the developer at the SR gap, it is desirable to satisfy an inequality of SR gap>SS gap. In other words, it is desirable to make the shortest distance between the toner supply roller 47 and the toner collection roller 48 greater than or equal to the shortest distance between the toner supply roller 47 and the developing roller 44.

Accordingly, to achieve both of enhancement of the effect of collecting the toner adhering onto the toner collection roller 48 and prevention of clogging with the developer at the SR gap, it is desirable to satisfy an inequality of SB gap≥SR gap≥SS gap.

Related Art

Figure 5:
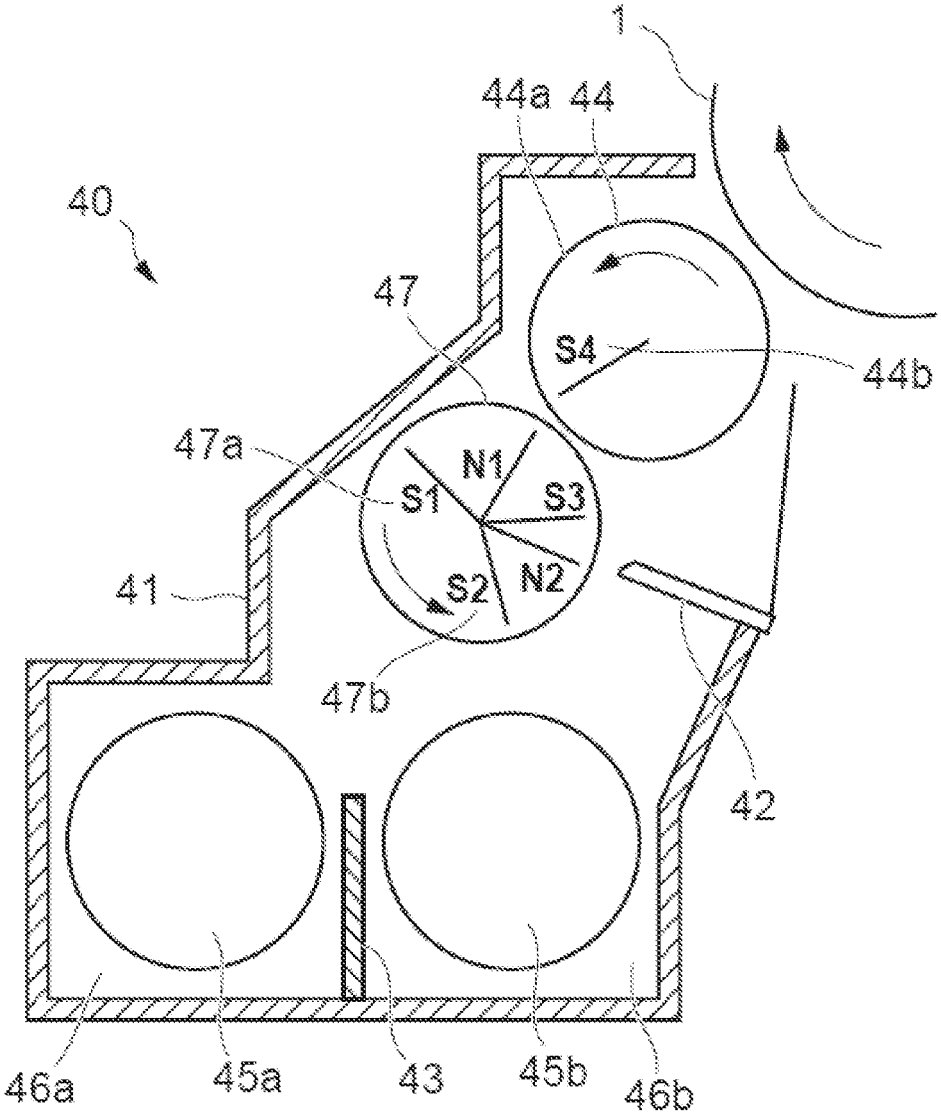
FIG. 5 RELATED ART
FIG. 5 is a cross-sectional view illustrating a configuration of a developing device in related art.

A configuration of a developing device in related art will be described with reference to FIG. 5.

A developing device 40 in the related art includes the developer container 41, the developing roller 44, the toner supply roller 47, and the developing blade 42. As illustrated in FIG. 5, in the developing device 40 in the related art, the toner collection roller 48 according to the first exemplary embodiment is not provided in the developer container 41.

During the image forming operation, namely, when the developing device 40 is driven, the toner is scattered from the toner supply roller 47, the developing roller 44, and the portion where the toner supply roller 47 and the developing roller 44 face each other, by rotation of the toner supply roller 47 and rotation of the developing roller 44. In the developing device 40 in the related art, however, since the toner collection roller 48 is not provided in the developer container 41, the scattered toner accumulates on the developing blade 42. In a case where the toner accumulating on the developing blade 42 adheres to the developing roller 44, defective image may be generated.

Comparative Example

Figure 6:
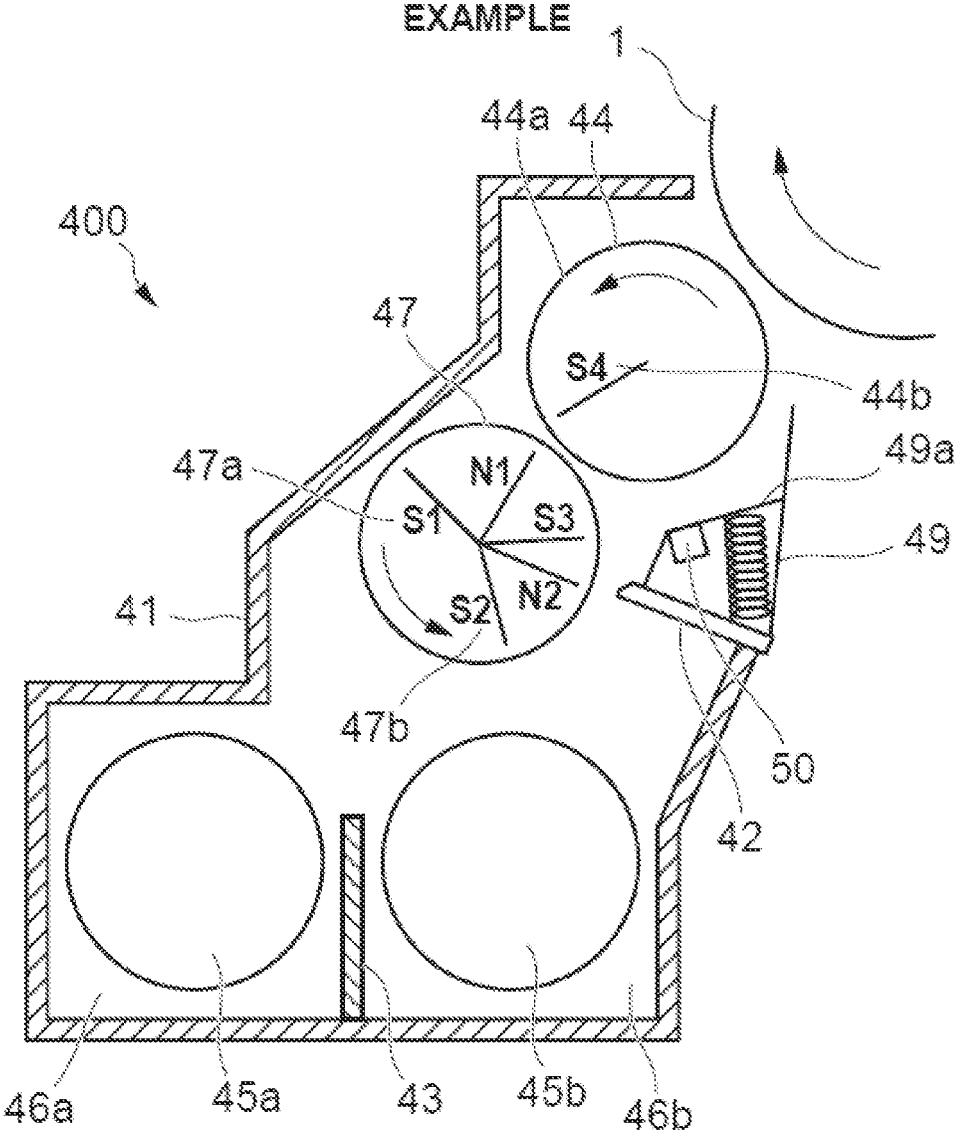
FIG. 6 is a cross-sectional view illustrating a configuration of a developing device according to a comparative example.

Next, a configuration of a developing device according to a comparative example will described with reference to a cross-sectional view in FIG. 6.

A developing device 400 according to the comparative example includes the developer container 41, the developing roller 44, the toner supply roller 47, and the developing blade 42. As illustrated in FIG. 6, in the developing device 400 according to the comparative example, the toner collection roller 48 according to the first exemplary embodiment is not provided in the developer container 41. In place thereof, in the developing device 400 according to the comparative example, a toner receiving support member 49 having a triangular cross-section is provided so as to protrude to the inside of the developer container 41, near the developing roller 44 on the right-side wall of the developer container 41. The toner receiving support member 49 is disposed along the longitudinal direction (direction perpendicular to paper surface in FIG. 6) of the developer container 41. An upper surface of the toner receiving support member 49 configures a wall portion that faces the toner supply roller 47 and the developing roller 44 and is inclined downward from the developing roller 44 toward the toner supply roller 47.

A toner receiving member 49*a* is provided along the longitudinal direction on the upper surface of the toner receiving support member 49. The toner receiving member 49*a* receives the toner scattered from the toner supply roller 47, the developing roller 44, and the portion where the toner supply roller 47 and the developing roller 44 face each other.

Further, a vibration member 50 vibrating the toner receiving member 49*a* is provided on a rear surface of the toner receiving member 49*a*. In the configuration of the developing device 400 according to the comparative example, the toner receiving member 49*a* is vibrated by the vibration member 50 when an image is not formed, which causes the toner accumulating on the toner receiving member 49*a* to slide down, and returns the toner to the toner supply roller 47.

As a result, when an image is not formed, the toner peeled off and falling from the developing roller 44 is returned to the toner supply roller 47. Since the developing blade 42 is also vibrated by vibration of the vibration member 50, the gap (SB gap) between the toner supply roller 47 and the developing blade 42 may be varied. Therefore, if the vibration member 50 vibrates during the image forming operation, density of the developer on the toner supply roller 47 may be varied, which may cause variation of image density and defective image.

On the other hand, if the toner excessively accumulates on the toner receiving member 49*a*, the toner accumulating on the toner receiving member 49*a* may drop onto the developing blade 42 and adhere to the toner supply roller 47 again during the image forming operation. The toner accumulating on the toner receiving member 49*a* is low in charge amount as compared with the toner circulating through the circulation path of the developer in the developer container 41. Therefore, in a case where the toner adhering onto the toner supply roller 47 again develops the electrostatic latent image on the photosensitive drum 1, defective image such as an image increased in density may be generated.

Accordingly, in the developing device 400 according to the comparative example, it is necessary to prevent the toner from excessively accumulating on the toner receiving member 49*a*. When the toner receiving member 49*a* is vibrated by the vibration member 50 in order to return the accumulating toner to the toner supply roller 47, it is necessary to stop the image forming operation. In addition, in the configuration of the developing device 400 according to the comparative example, if vibration frequency of the toner receiving member 49*a* is increased in order to prevent the toner from excessively accumulating on the toner receiving member 49*a*, stop frequency of the image forming operation is increased, which deteriorates productivity.

In contrast, in the first exemplary embodiment, the toner collection roller 48 is provided near the developing roller 44 and the toner supply roller 47. Further, in the developing device 4 including the toner supply roller 47 that supplies only the toner to the developing roller 44, the bias is applied to each of the toner supply roller 47, the developing roller 44, and the toner collection roller 48 during the image forming operation. As a result, in the first exemplary embodiment, during the image forming operation, the scattered toner can be returned to the circulation path of the developer from the portion where the toner supply roller 47 and the toner collection roller 48 face each other. In such a first exemplary embodiment, unlike the comparative example, it is unnecessary to stop the image forming operation in order to return the scattered toner to the circulation path of the developer, and the productivity is not deteriorated.

Table 2 illustrates a result of comparison about presence/absence of defective image (image contamination) caused by accumulation of the scattered toner and productivity among the first exemplary embodiment, the related art, and the comparative example.

TABLE 2

| | Prevention of Image Contamination caused by Accumulation of Scattered Toner | Productivity |
|---|---|---|
| Related Art | Poor | — |
| Comparative Example | Good | Poor |
| First Exemplary Embodiment | Good | Good |

As illustrated in Table 2, a defective image is generated in the related art, whereas a defective image is not generated in the first exemplary embodiment. Further, in the first exemplary embodiment, productivity is not lowered unlike the comparative example.

As described above, in the first exemplary embodiment, during the image forming operation, the potential difference that moves the normally charged toner from the toner supply roller 47 to the developing roller 44 is formed between the toner supply roller 47 and the developing roller 44. In addition, the potential difference that moves the normally charged toner from the toner collection roller 48 to the toner supply roller 47 is formed between the toner supply roller 47 and the toner collection roller 48.

As described above, the direct-current voltage (hereinafter, referred to as Vslv(DC)) and the alternating-current voltage (hereinafter, referred to as Vslv(AC)) are applied to the developing roller 44 by the bias application unit. Further, the direct-current voltage (hereinafter, referred to as Vmag (DC)) and the alternating-current voltage (hereinafter, referred to as Vmag(AC)) are applied to the toner supply roller 47. The direct-current voltages and the alternating-current voltages are applied to the developing roller 44 and the toner supply roller 47 from the developing bias electric power source (bias application unit) through the bias control circuit. As a result, the potential difference ΔV is formed between Vmag(DC) applied to the toner supply roller 47 and Vslv(DC) applied to the developing roller 44.

Further, the same electric power source applies the bias to each of the toner supply roller 47 and the toner collection roller 48. In the case of the same electric power source, the alternating-current voltage (Vmag(AC)) applied to the toner supply roller 47 is converted into the direct-current voltage by a rectification device, and the converted direct-current voltage is applied to the toner collection roller 48. This forms the potential difference ΔVcol between the toner collection roller 48 and the toner supply roller 47. Alternatively, the potential difference between the toner collection roller 48 and the toner supply roller 47 may be formed by stepping down, by a step-down circuit, the bias from the electric power source that applies the bias to the toner supply roller 47, and applying the stepped-down bias to the toner supply roller 47. Further alternatively, an electric power source applying the bias to the toner supply roller 47 may be different from the electric power source applying the bias to the toner collection roller 48.

A second exemplary embodiment will be described. In the first exemplary embodiment, an example in which the toner collection roller 48 disposed in the developer container 41 is made of a non-magnetic metal (non-magnetic body) is described. In contrast, in a second exemplary embodiment, the material of the toner collection roller 48 (conductive roller) disposed in the developer container 41 is changed from the non-magnetic metal to a magnetic metal. The second exemplary embodiment has substantially the same configuration as the configuration of the first exemplary embodiment except for change of a hardware configuration accompanied by change of the material of the toner collection roller 48 from the first exemplary embodiment. Therefore, repetitive descriptions are appropriately omitted.

In the second exemplary embodiment, the material of the toner collection roller 48 is changed to the magnetic metal, which makes it possible to increase the gap (SR gap) between the toner supply roller 47 and the toner collection roller 48 as compared with the first exemplary embodiment. Therefore, in the second exemplary embodiment, a degree of freedom in disposing the toner collection roller 48 in the developer container 41 is enhanced as compared with the first exemplary embodiment. The reason therefor will be described below.

In the second exemplary embodiment, the gap between the developing roller 44 and the toner collection roller 48 is set to 4000 μm, and the gap (SR gap) between the toner supply roller 47 and the toner collection roller 48 is set to 1000 μm.

Figure 7:
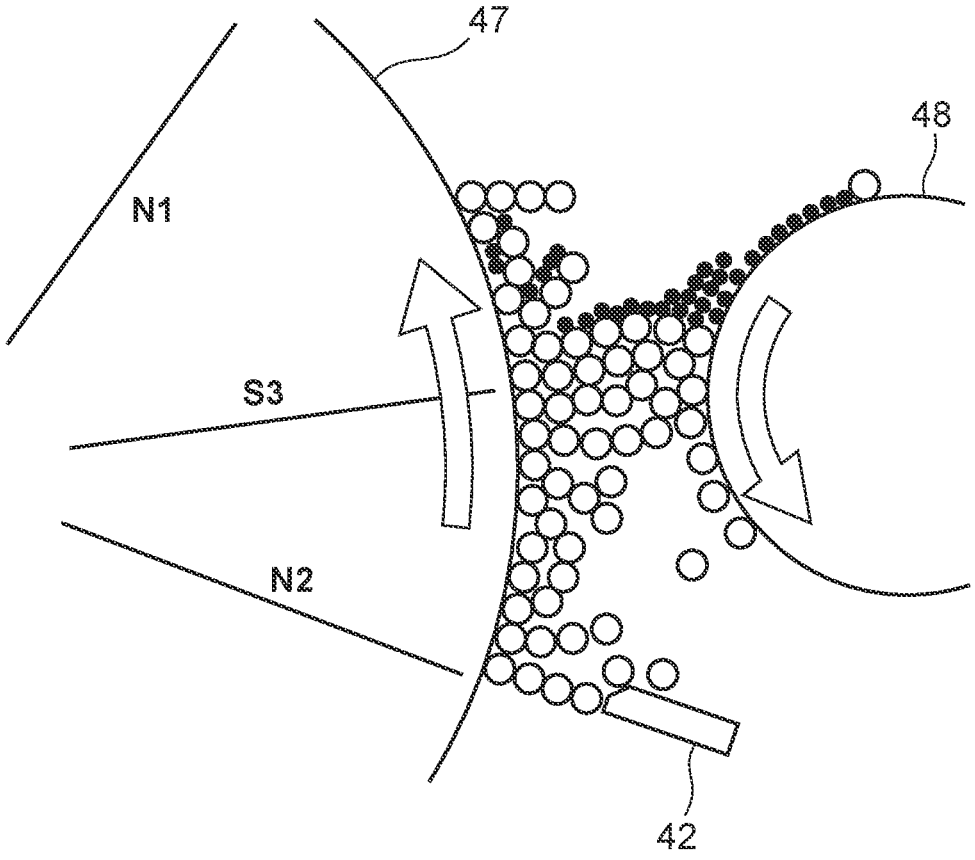
FIG. 7 is a schematic diagram illustrating a state where scattered toner is collected between a toner supply roller and a toner collection roller according to a second exemplary embodiment.
Figure 8:
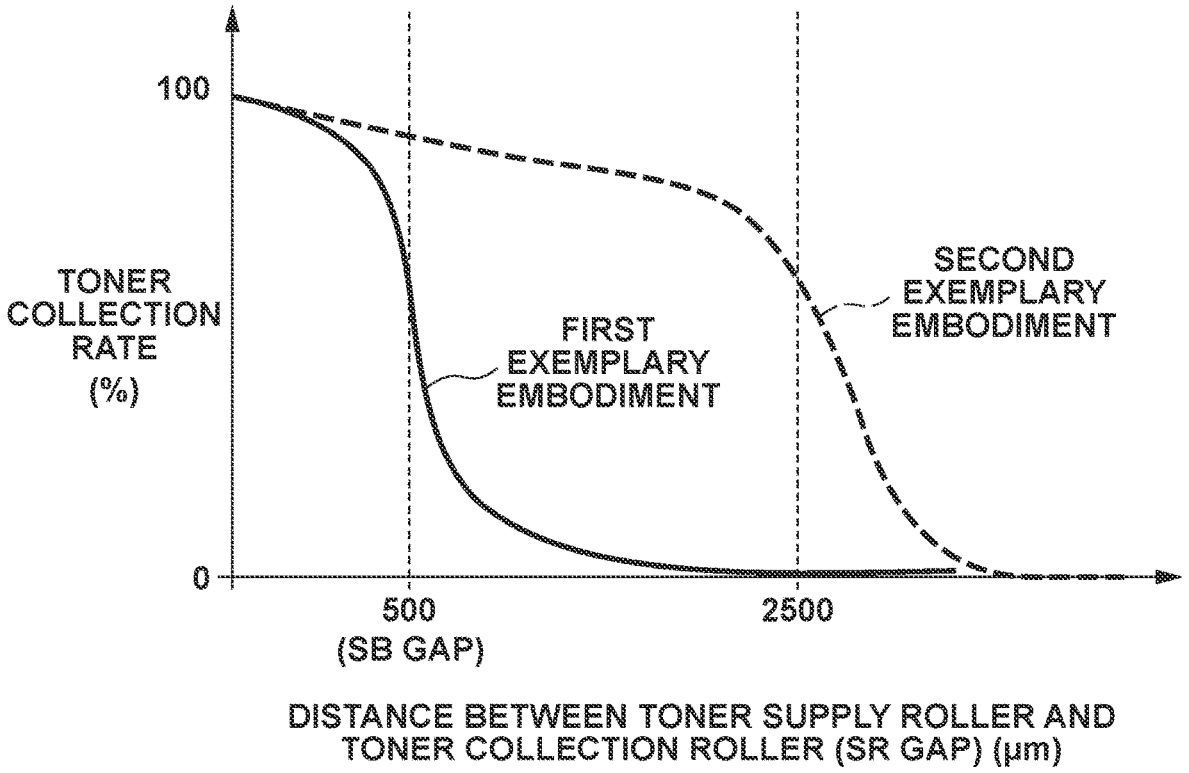
FIG. 8 is a diagram illustrating a relationship of a distance between the toner supply roller and the toner collection roller with a toner collection rate according to the second exemplary embodiment.
Figure 9:
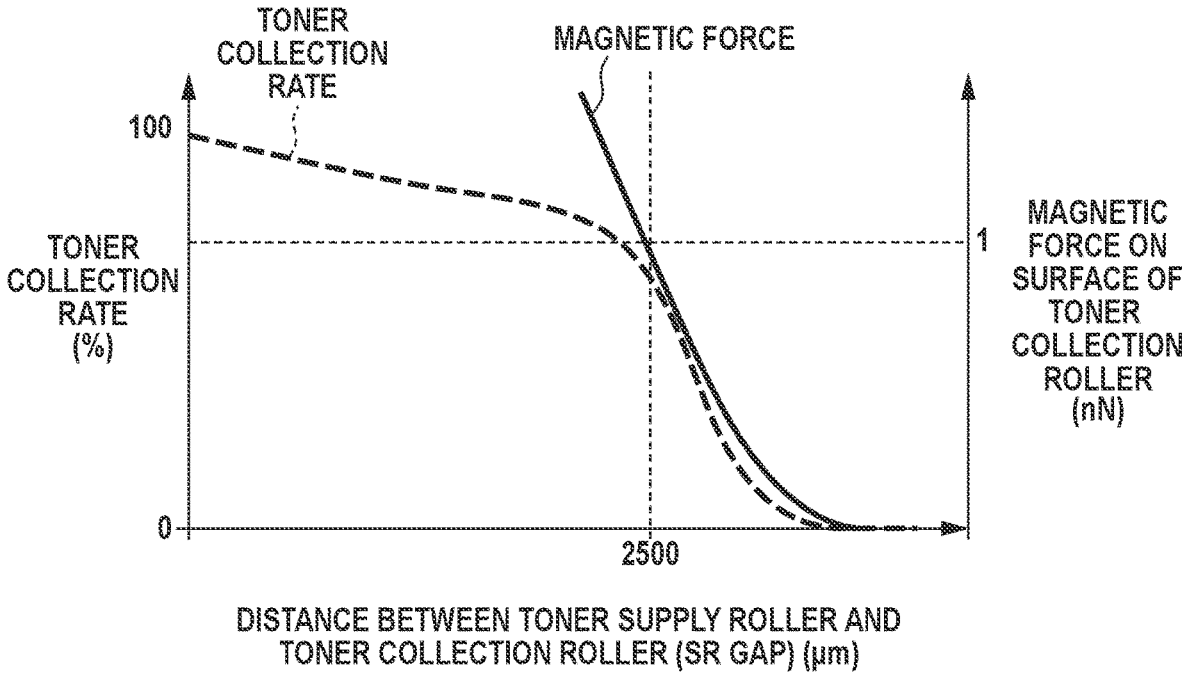
FIG. 9 is a diagram illustrating a relationship of the toner collection rate with magnetic force on a surface of the toner collection roller according to the second exemplary embodiment.

FIG. 7 is a schematic diagram illustrating a state where scattered toner is collected between the toner supply roller 47 and the toner collection roller 48 according to the second exemplary embodiment. FIG. 8 illustrates a relationship of the distance (SR gap) between the toner supply roller 47 and the toner collection roller 48 with a toner collection rate according to the second exemplary embodiment. FIG. 9 illustrates a relationship of the toner collection rate with magnetic force on the surface of the toner collection roller 48 (magnetic force Fr in normal direction of toner collection roller 48) according to the second exemplary embodiment.

In the second exemplary embodiment, since the toner collection roller 48 is made of a magnetic metal (magnetic roller), the toner collection roller 48 is magnetized by being influenced by magnetic force generated from the developing magnet 44*b*, and the magnetic brush on the toner supply roller 47 is extended. Therefore, even in a case where the gap (SR gap) between the toner supply roller 47 and the toner collection roller 48 is increased as illustrated in FIG. 7 as compared with the first exemplary embodiment, the toner collection roller 48 is magnetized, and the magnetic brush on the toner supply roller 47 is extended. This makes it possible to achieve an effect of collecting the scattered toner to the toner supply roller 47 side from the portion where the toner supply roller 47 and the toner collection roller 48 face each other. Therefore, even in the case where the SR gap is greater than the SB gap (SB gap is set to 500 μm in second exemplary embodiment) as illustrated in FIG. 8, the magnetic brush on the toner supply roller 47 comes into contact with the surface of the toner collection roller 48. This makes it possible to achieve the effect of collecting the toner on the toner collection roller 48 by the magnetic brush on the toner supply roller 47.

In the second exemplary embodiment, as in the first exemplary embodiment, the toner collection roller 48 is disposed to face the toner supply roller 47 at the position where the magnetic flux density of the magnetic pole S3 of the supply magnet 47*b* (magnetic flux density Br of magnetic pole S3 in normal direction of toner supply roller 47) has a peak. On the other hand, it is sufficient to dispose the toner collection roller 48 at a position where the magnetic brush on the toner supply roller 47 comes into contact with the toner collection roller 48. Therefore, the toner collection roller 48 is not necessarily located at the position facing the position where the magnetic flux density of the magnetic pole S3 of the supply magnet 47*b* has a peak.

In the second exemplary embodiment, sensitivity of the SR gap depends on magnetic force on the surface of the toner collection roller 48. This is because the extended degree of the magnetic brush on the toner supply roller 47 is increased as the magnetic force on the surface of the toner collection roller 48 when the toner collection roller 48 is magnetized by the magnetic force generated from the developing magnet 44*b* is increased, and the SR gap can be accordingly increased.

As illustrated in FIG. 9, in a case where the magnetic force Fr on the surface of the toner collection roller 48 is less than or equal to 1 nN, the magnetic brush on the toner supply roller 47 cannot be sufficiently extended even though the SR gap is increased, which deteriorates efficiency of collecting the scattered toner. Accordingly, in the second exemplary embodiment, it is sufficient to set the SR gap such that the magnetic force on the surface of the toner collection roller 48 is greater than 1 nN. In the example of FIG. 9, making the SR gap less than 2500 μm can make the magnetic force on the surface of the collection roller 48 greater than 1 nN.

In the second exemplary embodiment, since the material of the toner collection roller 48 is changed to the magnetic metal (magnetic roller), it is possible to prevent the toner collection rate from being reduced even in the case where the SR gap is made greater than the SR gap in the first exemplary embodiment as illustrated in FIG. 8. For example, in a case where the SR gap is set to 350 μm in the first exemplary embodiment, the SR gap can be made greater than 350 μm in the second exemplary embodiment. In the second exemplary embodiment, the SR gap is set to 1000 μm, it is possible to make the magnetic force on the surface of the toner collection roller 48 greater than 1 nN as illustrated in FIG. 9.

Influence by attachment tolerance when the toner collection roller 48 is attached to the inside of the developer container 41 can be reduced as the SR gap is increasable (i.e., as degree of freedom of SR gap is increasable). Therefore, when the material of the toner collection roller 48 is changed to the magnetic metal (magnetic roller), it is possible to maintain the effect of collecting the scattered toner without setting the SR gap with high accuracy (without performing fine adjustment to reduce attachment tolerance).

Table 3 illustrates a result of comparison of presence/absence of a defective image (image contamination) caused by accumulation of the scattered toner, productivity, and the degree of freedom of the SR gap among the first exemplary embodiment, the second exemplary embodiment, the related art, and the comparative example. The degree of freedom of the SR gap indicates the degree of freedom in disposing the toner collection roller 48 in the developer container 41.

TABLE 3

| | Prevention of Image Contamination caused by Accumulation of Scattered Toner | Productivity | Degree of Freedom of SR Gap |
|---|---|---|---|
| Related Art | Poor | — | — |
| Comparative Example | Good | Poor | — |
| First Exemplary Embodiment | Good | Good | Good |
| Second Exemplary Embodiment | Good | Good | Excellent |

As illustrated in Table 3, in the second exemplary embodiment, the degree of freedom of the SR gap can be enhanced while a defective image (image contamination) caused by accumulation of the scattered toner is prevented and productivity is maintained as compared with the first exemplary embodiment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-017379, filed Feb. 5, 2021, which is hereby incorporated by reference herein in its entirety.

What is claimed is:

1. An image forming apparatus comprising:

an image carrier;

an exposure device configured to expose the image carrier to form an electrostatic latent image on the image carrier;

a developing device including (i) a first chamber configured to accommodate a developer containing toner and carriers, (ii) a second chamber separated from the first chamber by a partition wall and configured to form a circulation path with the first chamber for the developer, (iii) a first conveyance screw disposed in the first chamber and configured to convey the developer in a first direction, (iv) a second conveyance screw disposed in the second chamber and configured to convey the developer in a second direction opposite to the first direction, (v) a developing roller that is rotatable, disposed to face the image carrier, and configured to carry and convey the toner to a developing position where the electrostatic latent image formed on the image carrier is developed, (vi) a toner supply roller that is rotatable, disposed to face the developing roller, and configured to carry and convey the developer supplied from the first chamber and to supply only the toner to the developing roller, and (vii) a regulation member disposed to face the toner supply roller and configured to regulate an amount of developer carried by the toner supply roller; and a conductive member disposed to face the toner supply roller on a downstream of a position on the toner supply roller where the regulation member comes closest to the toner supply roller and on an upstream of a position on the toner supply roller where the developing roller comes closest to the toner supply roller, in the rotation direction of the toner supply roller, wherein a rotation direction of the toner supply roller is opposite to a rotation direction of the developing roller at a position where the toner supply roller and the developing roller face each other, wherein the toner supply roller internally includes a first magnet, where the first magnet is fixed and disposed not to be rotatable and includes a plurality of magnetic poles including a first magnetic pole, wherein the developing roller internally includes a second magnet, where the second magnet is fixed and disposed not to be rotatable, and includes only a second magnetic pole that is disposed to face the first magnetic pole and is different in polarity from the first magnetic pole, wherein a polarity of a direct-current component of a bias applied to the conductive member during an image forming operation, a polarity of the direct-current component of a bias applied to the toner supply roller during the image forming operation, and a polarity of the direct-current component of a bias applied to the developing roller during the image forming operation are the same as a polarity of normally charged toner, wherein an absolute value of the bias applied to the developing roller during the image forming operation is smaller than an absolute value of the bias applied to the toner supply roller during the image forming operation, and wherein the absolute value of the bias applied to the toner supply roller during the image forming operation is smaller than an absolute value of the bias applied to the conductive member during the image forming operation.

2. The image forming apparatus according to claim 1, wherein the conductive member is a conductive roller, and wherein a shortest distance between the toner supply roller and the conductive roller is shorter than a shortest distance between the developing roller and the conductive roller.

3. The image forming apparatus according to claim 1, wherein the conductive member is a conductive roller, and wherein a shortest distance between the toner supply roller and the conductive roller is greater than or equal to a shortest distance between the toner supply roller and the developing roller.

4. The image forming apparatus according to claim 1, wherein the conductive member is a conductive roller that is non-magnetic, and wherein a shortest distance between the toner supply roller and the conductive roller is 300 μm or more and 500 μm or less.

5. The image forming apparatus according to claim 1, wherein the conductive member is a conductive roller that is magnetic, and wherein, in a state where the conductive roller is magnetized by magnetic force of the first magnet, magnetic force in a normal direction of the conductive roller is greater than 1 nN.

6. The image forming apparatus according to claim 1, wherein the conductive member is a conductive roller that is rotatable, and wherein, at a position where the toner supply roller and the conductive roller face each other, a rotation direction of the conductive roller is opposite to the rotation direction of the toner supply roller.

7. The image forming apparatus according to claim 1, wherein the conductive member is a conductive roller that is rotatable, and wherein a rotation axis of the conductive roller is positioned above a rotation axis of the first conveyance screw in a vertical direction.

8. The image forming apparatus according to claim 1, wherein a rotation axis of the toner supply roller is positioned above a rotation axis of the first conveyance screw in a vertical direction and is positioned below a rotation axis of the developing roller in the vertical direction.

9. The image forming apparatus according to claim 1, further comprising a common electric power source, wherein the common electric power source is configured to supply electric power to apply the bias to the toner supply roller and to supply electric power to apply the bias to the conductive member during the image forming operation.

10. The image forming apparatus according to claim 1, further comprising:

a first electric power source configured to supply electric power to apply the bias to the toner supply roller during the image forming operation; and a second electric power source configured to supply electric power to apply the bias to the conductive member during the image forming operation.

* * * * *